US005490343A

United States Patent [19]

Cory et al.

[11] Patent Number: 5,490,343

[45] Date of Patent: Feb. 13, 1996

[54] SAFETY DEVICE FOR DEFENSIVE WEAPON AND SPECIAL CARTRIDGE

[76] Inventors: Thornton E. Cory, P.O. Box 9790, Houston, Tex. 77213; John N. Gold, Jr., P.O. Box 690265, Houston, Tex. 77070

[21] Appl. No.: 306,644

[22] Filed: Sep. 15, 1994

[51] Int. Cl.[6] ..... F41A 17/26

[52] U.S. Cl. ..... 42/70.08; 89/1.41

[58] Field of Search ..... 42/70.08, 66, 70.01; 89/1.41, 127

[56] References Cited

U.S. PATENT DOCUMENTS

| | | | |
|---|---|---|---|
| 375,799 | 1/1888 | Bye | 42/66 |
| 430,243 | 6/1890 | Wheeler | 42/66 |
| 465,179 | 12/1891 | Johnson et al. | 42/66 |
| 565,678 | 8/1896 | Foster | 42/70.08 |
| 795,816 | 8/1905 | Bye | 42/66 |
| 849,825 | 4/1907 | Allen | 42/66 |
| 879,018 | 2/1908 | Stone | 42/66 |
| 1,313,073 | 8/1919 | Donadio | 42/70.08 |
| 3,352,046 | 11/1967 | Warner et al. | 42/106 |
| 3,431,853 | 3/1969 | Warner et al. | 102/370 |
| 3,949,508 | 4/1976 | Elkag | 42/70.08 |
| 4,400,901 | 8/1983 | Hillberg | 42/70.08 |
| 4,461,110 | 7/1984 | Inderbitzen | 42/66 |
| 4,628,626 | 12/1986 | Brandt | 42/70.08 |

FOREIGN PATENT DOCUMENTS

| | | | |
|---|---|---|---|
| 453020 | 9/1936 | United Kingdom | 42/70.08 |

*Primary Examiner*—Stephen M. Johnson
*Attorney, Agent, or Firm*—Gunn & Associates

[57] ABSTRACT

A safety for the defensive weapon set forth in U.S. Pat. No. 3,352,046 is disclosed. The safety incorporates an elongated lever which moves between safe and firing positions. The lever is mounted on a pivot pin. A pair of dished areas serve as locking detents. A spring loaded hemispheric member rides against the lever and locks the levers so that the lever is prevented from movement accidentally and can only be moved by hand operation of the lever between safe and firing positions.

11 Claims, 1 Drawing Sheet

SAFETY DEVICE FOR DEFENSIVE WEAPON AND SPECIAL CARTRIDGE

BACKGROUND OF THE DISCLOSURE

The present disclosure is directed to a safety device which finds special application in the defensive weapon, not a firearm, which is set forth in U.S. Pat. No. 3,352,046 and also U.S. Pat. No. 3,431,853. These two patents together describe a protective or defensive device which is a hand held weapon having a body with a barrel, the barrel including one or more cylindrical passages to receive charged cartridges. The several cartridges, four being the preferred number, fit within a barrel terminating in a muzzle plate at the distal end of the device to lock the cartridges in place. The device is further equipped with a handle that fits neatly in the grip of a person of average hand size and is equipped with a trigger and trigger guard. The two patents describe the mechanism by which the weapon is operated. In contrast with firearms, no projectal is fired. The cartridge is detonated which creates a spreading cloud of powder or gas which, depending on the makeup of the cloud, incapacitates a person, animal, etc. Precise aiming is not required. The cloud spreads so that it is effective to a fairly wide dimension at 15–25 feet. This especially provides a personal weapon of a nonfatal nature. In a typical commercial version, the device can be readily carried in the pocket or purse. The present disclosure sets forth improvements in the prior apparatus in that it is provided with a safety mechanism so that accidental firing in the purse or pocket is prevented. The two referenced patents are incorporated by reference to set forth one embodiment of the underlying apparatus so that a protective weapon can be constructed in accordance with the teachings of the two patents mentioned above.

The present disclosure enhances the structure previously described in the two mentioned patents so that a safety mechanism is included. The safety mechanism provides a protruding tab at the back end of the barrel and above the handle so that a person is able to operate the safety with simple thumb movement even while the index finger is wrapped around the handle and the finger rests on the trigger. More importantly, the finger resting on the trigger is able to obtain proper positioning and leverage for ordinary operation without interfering to set or release the safety on the device. Special movements of the hand are not required to set or release the safety. The safety provides a binary function in that it is either off or on. It is preferably constructed with detents so that it clicks to one or the other position. This avoids ambiguity, meaning there is no intermediate position where it is neither on or off. The safety thus provides this binary function for operation of the defensive weapon. On the interior of the defensive weapon, the handle incorporates a spring loaded arm which is located to block movement or operation of a hammer and yet provides a hammer closing movement. Moreover, the device incorporates a firing pin mechanism which strikes one of the inserted cartridges. The preferred form of the apparatus utilizes a barrel having a 2×2 deployment of 4 tubes which comprise the cartridges. The tubes each enclose the appropriate explosive material such as powder, detonator and are closed by suitable packing or wading. On the interior, the tube supports the necessary explosive charge which propels the powder to form a dispersal in space. Moreover, an air activated gas can be created by the use of suitable constituents in this charge. Contrary to most weapons, a projectile such as a lead bullet is not fired. It does not constitute a firearm in the least. Rather, it is a defensive weapon of the sort which can fend off an intruder, barking dog, etc. The cloud of powder and gas liberated by an air activated powder serves an adequate deterrent to anyone who is physically close to the weapon. It is especially effective in close quarters.

For security sake, the present device controls firing of the weapon by providing the safety as mentioned which cooperates with the 2×2 deployment of cartridges. More specifically, the system enables a breach block to support the cartridges deployed in parallel and supported at common plane at the breach block which are then struck by a firing pin mechanism supported on a hammer. This is shown in some detail in FIGS. 3–6 of the '046 reference mentioned above. The present disclosure incorporates a mechanism which locks the hammer on the interior of the handle so that hammer striking is prevented.

One aspect of the present disclosure is the incorporation of a hammer mechanism which is substantially on the interior save and except that portion which is operated. More specifically, operation is achieved by virtue of thumb movement of a short, protruding, serrated lever which extends from the interior of the body. This provides a lock mechanism. The lever is a safety because the thumb operated lever is connected with an elongated push rod terminating in a protruding bar at the end of the structure. This locks the hammer in the forward most position. Trigger operation will not thereafter cause the hammer to strike because the hammer cannot be cocked. Having summarized certain operational aspects of the safety in conjunction with the defensive weapon, the present disclosure sets forth specific details which spell out the construction of the device and provide a mode of operation of the preferred embodiment.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may add to other equally effective embodiments.

DETAILED DESCRIPTION OF THE PREFERRED EMBODIMENT

Figure 1:
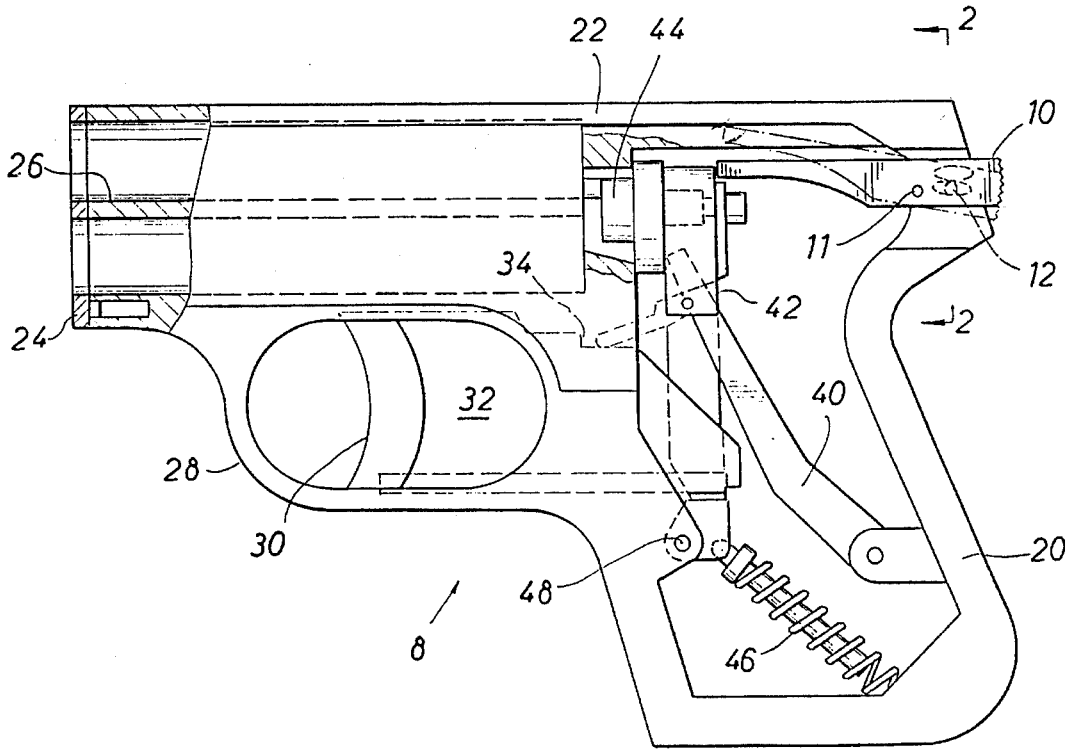
FIG. 1 is a side view of a defensive weapon incorporating a safety in accordance with the teachings of this disclosure and further showing the safety in a full-line position and a dotted line release position with certain portions of the weapon broken away for clarity of illustration.

Attention is first directed to the defensive weapon 8 of the present disclosure. As mentioned it is described in substantial detail in the above mentioned references. They are incorporated to set forth specifics and details of the defensive weapon 8. More importantly, the device incorporates the safety 10 of the present disclosure which is pivotally mounted on a transverse pin 11. The safety is constructed with a locking mechanism having the form of a coil spring urging a bead 12 against the safety 10. This safety is provided with two dished areas which serve as detents locking the device either on or off. In other words, the safety is either engaged or disengaged. Ambiguity is prevented by the two dished areas.

To place the safety mechanism in its proper context, some description of the defensive weapon is required. It is constructed with a handle 20 terminating at a barrel 22 which extends forwardly and incorporates a muzzle plate 24. One or more cartridges is inserted in the shaped cartridge receiving passages 26. The barrel is above a trigger guard 28 which protects a trigger 30. Trigger movement is accomplished by forcing a plate 32 rearwardly. The plate 32 includes a shoulder 34 which is located so that it transfers movement for firing.

The handle 20 is formed with opposing side plates which have been removed for sake of clarity. This exposes a rather long lever or arm 40 which is readily seen in FIG. 1 of the drawings. The lever bears against a hammer 42 which operates a firing pin mechanism 44. The firing pin mechanism incorporates a mechanism causing the firing pin to rotate so it can strike the four cartridges in sequence on four different operations. Recalling that they are arranged in a 2×2 deployment, a ratchet mechanism causes the firing pin to rotate, thereby striking the cartridges for firing.

The hammer is rotated toward the upstanding position shown in FIG. 1 by a compressible coil 46. The coil is a return mechanism which is overcome by the user on pulling the trigger 30. As viewed in FIG. 1 of the drawings, the coil 46 is compressed when the trigger is pulled.

The intended and ordinary operation of the weapon should be considered. Four cartridges are located in the barrel. In effect, they serve as a their own gun barrel mechanism. The cartridges are typically full diameter along the full length. They are locked in place in a manner described in the referenced patents. This exposes the back ends of the cartridges for firing and firing is accomplished in the following manner. When the four cartridges are installed, they are supported in the breech block at the back end of the cartridge chamber 26. The breech block is immediately adjacent to the hammer. The hammer 42 rests in the full line position of FIG. 1 ordinarily. On firing, it rotates clockwise as shown in FIG. 1, rotating about a pivot point 48 at the lower end of the hammer. This rotation creates a spring return force which urges the hammer to a striking position. As the trigger slides to the right, the shoulder 34 is ultimately released, and the hammer is then free to fire rapidly on movement to the left, and is restored to the full line position of FIG. 1 of these drawings. Again, greater details can be found in the referenced patents. On such movement, the hammer carries the firing pin so it strikes hard against the indexed cartridge, and repeated operations enable repeated indexing for repeated firing. Moreover, this device is constructed so that operation occurs wholly within the handle mechanism. There is no external hammer. There is no external mechanical movement. There is no externally visible or externally manifested operation. In that sense, the defensive weapon 8 is quite streamline and relatively easy to use. Perhaps it is the ease of use which is somewhat misleading in the context. All that is required is to pull the trigger and the device will fire. The present disclosure provides a safeguard in that a safety mechanism is incorporated.

Figure 2:
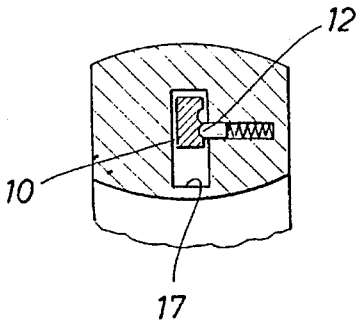
FIG. 2 is a sectional view along the line 2—2 of FIG. 1 which shows the safety mechanism and a locking, spring loaded mechanism permitting movement between two positions.
Figure 3:
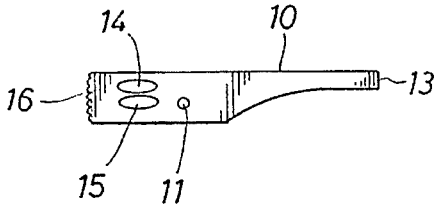
FIG. 3 is a side view of the safety lever illustrated apart from the defensive weapon.

The full line position shown in FIG. 1 of the drawings shows the hammer in the rest position. The safety is in the form of an elongated lever having a distal end 13. That is cut to a length and shaped so that it readily blocks the hammer mechanism. It is mounted in the handle to block hammer movement completely. The safety pivots around the mounting pin 11. The safety is moved to that position to block or barricade hammer operation. Furthermore, the end 13 in the full line position prevents movement indefinitely. That is terminated only on repositioning the safety. As shown in FIG. 3 of the drawings, the safety is formed of plate stock which is machined to form two dished areas. The upper dished area 14 is similar to the lower dished area 15. These two areas serve as positive locks. The bead 12 is constructed with a round or hemispheric head. By virtue of the spring which urges it towards the lever, the round head rides in one or the other two detents. The two detents are constructed so that the two detents receive the round bead 12 in one or the other. The detents are close to each other. The two detents have very little face material between the two and are substantially close so that the detent forces the bead 12 into one or the other. The end of the safety is serrated at 16. The safety device is mounted in a shaped slot 17 better shown in FIG. 2 of the drawings. It is formed in the rearward portions of the barrel. The two positions are achieved with modest rotation of the safety having the form of a rotatable lever. The pivot point is the mounting rod 11. The rod 11 passes through the barrel structure at the requisite location to fasten the lever into position. Moreover, the user observes the cooperative slot 17 which holds the safety mechanism at the position illustrated in FIG. 1 of the drawings. This visually exposes only a fraction of an inch of the lever. This exposes only a portion so that the user can simply slide their thumb over the serrations 16 to set the safety. In the full line position, the safety is on which prevents firing. In the dotted line position the safety is off which permits firing. This construction enables proper operation of the weapon 8 under control of the safety mechanism.

While the foregoing is directed to the preferred embodiment, the scope is determined by the claims which follow.

We claim:

1. A safety for a defensive weapon having a cased cartridge mounted therein wherein the defensive weapon includes:

(a) a barrel above a handle;

(b) a cartridge receiving chamber within said barrel;

(c) a movable trigger connected with a hammer on the interior of the handle;

(d) a firing pin operated by the hammer to strike said cartridge in said barrel to fire said cartridge;

(e) said safety including (1) an elongated lever having a hand operated end and also a locking end;

(2) a pivot supporting said lever to permit movement of said lever between a safe position and a firing position; and (3) means for locking said safety in the safe position or firing position; wherein said locking means comprises two shoulder defined dimples on said lever and a releasable lock member engages one of said dimples at a shoulder thereof.

2. The apparatus of claim 1 wherein said pivot comprises a mounting pin pivotally mounting said lever to expose said hand operated end and said locking end is on the interior of said handle abutting against said hammer.

3. The apparatus of claim 1 wherein said hammer has an initial position and moves to a firing position; and said safety prevents hammer movement to the firing position.

4. The apparatus of claim 3 wherein said safety blocks said hammer from movement.

5. The apparatus of claim 1 wherein said locking means comprises a spring urged rounded bead bearing against said lever.

6. The apparatus of claim 5 wherein said bead is captured in one of said dimples on said lever.

7. The apparatus of claim 6 wherein said lever includes a central raised face portion between said two dimples.

8. A safety for a defensive weapon having a cased cartridge mounted therein wherein the defensive weapon includes:

(a) a barrel above a handle;

(b) a cartridge receiving chamber within said barrel;

(c) a movable trigger connected with a hammer on the interior of the handle;

(d) a firing pin operated by the hammer to strike said cartridge in said barrel to fire said cartridge;

(e) said safety including (1) an elongated lever having a hand operated end and also a locking end;

(2) a pivot supporting said lever to permit movement of said lever between a safe position and a firing position;

(3) means for locking said safety in the safe position or firing position comprised of a plurality of dimples on said lever; and (f) said locking means comprises:

(1) a rounded bead bearing against said lever;

(2) said bead is captured selectively in one of said dimples; and (3) said lever includes a central raised face portion between said dimples.

9. The apparatus of claim 8 wherein said pivot comprises a mounting pin pivotally mounting said lever having an exposed, hand operated end and a locking end on the interior of said handle abutting against said hammer.

10. The apparatus of claim 8 wherein said hammer has an initial position and moves to a firing position; and said safety prevents hammer movement to the firing position.

11. The apparatus of claim 10 wherein said safety blocks said hammer from movement.

* * * * *